United States Patent [19]

Gilliland

[11] Patent Number: 4,496,157

[45] Date of Patent: Jan. 29, 1985

[54] THREE PLAYER BACKGAMMON GAMEBOARD

[76] Inventor: Claire Gilliland, 2616 Gibson, Everett, Wash. 98204

[21] Appl. No.: 428,047

[22] Filed: Sep. 29, 1982

Related U.S. Application Data

[62] Division of Ser. No. 230,718, Feb. 2, 1981.

[51] Int. Cl.[3] ..... A63F 3/00

[52] U.S. Cl. ..... 273/248

[58] Field of Search ..... 273/248, 258, 236, 242, 273/243; D21/34, 15

[56] References Cited

U.S. PATENT DOCUMENTS

| | | | |
|---|---|---|---|
| D. 85,066 | 9/1931 | Sternan | 273/248 X |
| 2,495,007 | 1/1950 | Howard | 273/243 |
| 4,058,319 | 11/1977 | Thomas et al. | 273/248 |
| 4,124,212 | 11/1978 | Nomart | 273/248 |
| 4,286,787 | 9/1981 | Barber | 273/248 |
| 4,342,458 | 8/1982 | Lane et al. | 273/248 |

FOREIGN PATENT DOCUMENTS

| | | | |
|---|---|---|---|
| 401042 | 3/1909 | France | 273/248 |
| 113416 | 3/1945 | Sweden | 273/248 |
| 2028668 | 3/1980 | United Kingdom | 273/248 |

*Primary Examiner*—Richard C. Pinkham
*Assistant Examiner*—Scott L. Brown
*Attorney, Agent, or Firm*—Seed and Berry

[57] ABSTRACT

A game board for three player backgammon or related games. The board has three rows of twelve points with a bar dividing the three rows into six point boards. Three boards, one from each row, are used as the home boards for the players.

5 Claims, 5 Drawing Figures

THREE PLAYER BACKGAMMON GAMEBOARD

DESCRIPTION

This application is a division of U.S. patent application Ser. No. 230,718, filed Feb. 2, 1981.

TECHNICAL FIELD

This invention relates to a gameboard especially suited for play with three players. It also relates to methods for playing backgammon, and its variations with three players, or three teams of players.

BACKGROUND ART

Backgammon and its variants are ancient games designed for play with two players. With the recent revival of these games, there has developed a greater demand for games in which more players can participate. Harmon discloses in U.S. Pat. No. 222,272 a gameboard which contains indicia for playing and for scoring checkers, chess, backgammon, cribbage, whist, and pedro. Thomas et al. disclose in U.S. Pat. No. 4,058,318 a multi-player backgammon game. The board has forty-eight points on which each player moves in an L-shaped path. Preferably, the board is used for four players. It may also be used with three. Two types of three-player games are disclosed. Over twenty-four points, each player may move so that his first twelve points overlap one opponent while his second twelve overlap the other. Alternatively, the three players may move in an extended game over thirty-six points. Each player encounters each of the other players on at least two of the playing boards. The paths of play are such that each player does not entirely overlap the points of its opponents in its course through thirty-six points. Normart discloses in U.S. Pat. No. 4,124,212 a new variation of the traditional backgammon game. This four-player game has eight sets of six points arranged in tables. The points of each table are colored to designate which player may assume that table as a path. Thus, in a complicated fashion, the four players interact in an otherwise common backgammon game. U.S. Pat. Nos. DES. 85,066 and 97,078 disclose gameboards with six tables of six points each.

DISCLOSURE OF INVENTION

A preferred gameboard especially adapted for three-party play comprises three substantially parallel rows of twelve points each. Each row of twelve points may be split between its sixth and seventh point by a bar which will divide each row into two tables of six points each, generally referred to as the home and outer board of each player. This gameboard readily allows play by two players because two rows are easily recognizable as a common backgammon board. The third row, however, makes the board particularly suited for three players.

A preferred method of using this gameboard comprises play of a new variation of backgammon. The novel backgammon game for three players preferably comprises the possibility of interaction with each portion of the opponent's paths, although any man need only travel over twenty-four points before it may be borne off. To accomplish this feature, a hit man may reenter play on the one-point of either opponent and progress through that opponent's boards to the home board of the player. Similarly, Dutch backgammon, Acey-Deucey, European Acey-Deucey, and Tabard backgammon may also be played with three players potentially interacting over the entire gameboard. Turkish backgammon (gioul) and Greek backgammon (plakoto) may be played with three players. In gioul or plakoto, however, a player interacts with one opponent over the first twelve points of travel and a second player during the final twelve points.

BEST MODE FOR CARRYING OUT THE INVENTION

This specification will assume that the traditional games of backgammon, Dutch backgammon, Acey-Deucey, European Acey-Deucey, Tabard backgammon, plakoto, and gioul are understood. To refresh one's recollection, in any of these games two players contact on a board with twenty-four points. The directions of travel are in opposed, U-shaped paths. Backgammon is cursorily described in Normart, U.S. Pat. No. 4,124,212. Dutch backgammon is played in the same way as backgammon, with the following exceptions: All men start on the bar. Each player must enter all his men before advancing any of them. No player may hit an opponent's man until he has moved at least one of his own men around to his own home board. Acey-Deucey is an elaboration of Dutch backgammon. Although all men start on the bar, each player may advance a man while others remain on the bar. The roll of an ace-deuce (1–2) requires: (1) the play of the roll 1–2; (2) the selection of any double number by said player and moving accordingly; and (3) taking an additional throw of the dice. If any portion of the roll is not used, the rest of the Acey-Deucey privileges are lost. European Acey-Deucey sets up on the board as in regular backgammon and is played like Acey-Deucey with the following additions: After naming the desired double following a 1–2 roll, the player moves that double AND the complementary double, and then rolls again. (The complement of a number is its difference from 7.) To bear off, the player must roll the exact number of the point on which he has men. Tabard backgammon is different only in setup from regular backgammon. The same number of pieces are set up on the same points but all of one player's men are in the outer and home boards of the opponent. From there on, the play is identical to backgammon. Plakoto is a Greek variation of backgammon in which no man may be hit from the board. Instead, a man may be immobilized by pointing onto it by an opponent's man. The risk of exposing a man can be much more severe than in backgammon. Gioul is a Turkish variation in which occupation of a point by a single man precludes pointing thereon. Thus a single man is as powerful as the double man point of backgammon. A prime may be developed with only six men. Gioul also greatly rewards a throw of doubles. Not only do you get to point twice each value thrown, but you get each pair of doubles, up to sixes, that you can move. To counter the tremendous advantage of doubles, the rules allow an opponent to assume the pointing of the the remaining values if his opponent becomes blocked. As further explanation, a roll of double threes would allow the roller to move four threes, four fours, four fives, and four sixes. If unable to move further after three fives, the fives must be recounted, and the opponent gets the advantage of the four fives and four sixes. When he cannot move all of a set of values or when all values are played, play continues with the next roll.

Figure 1:
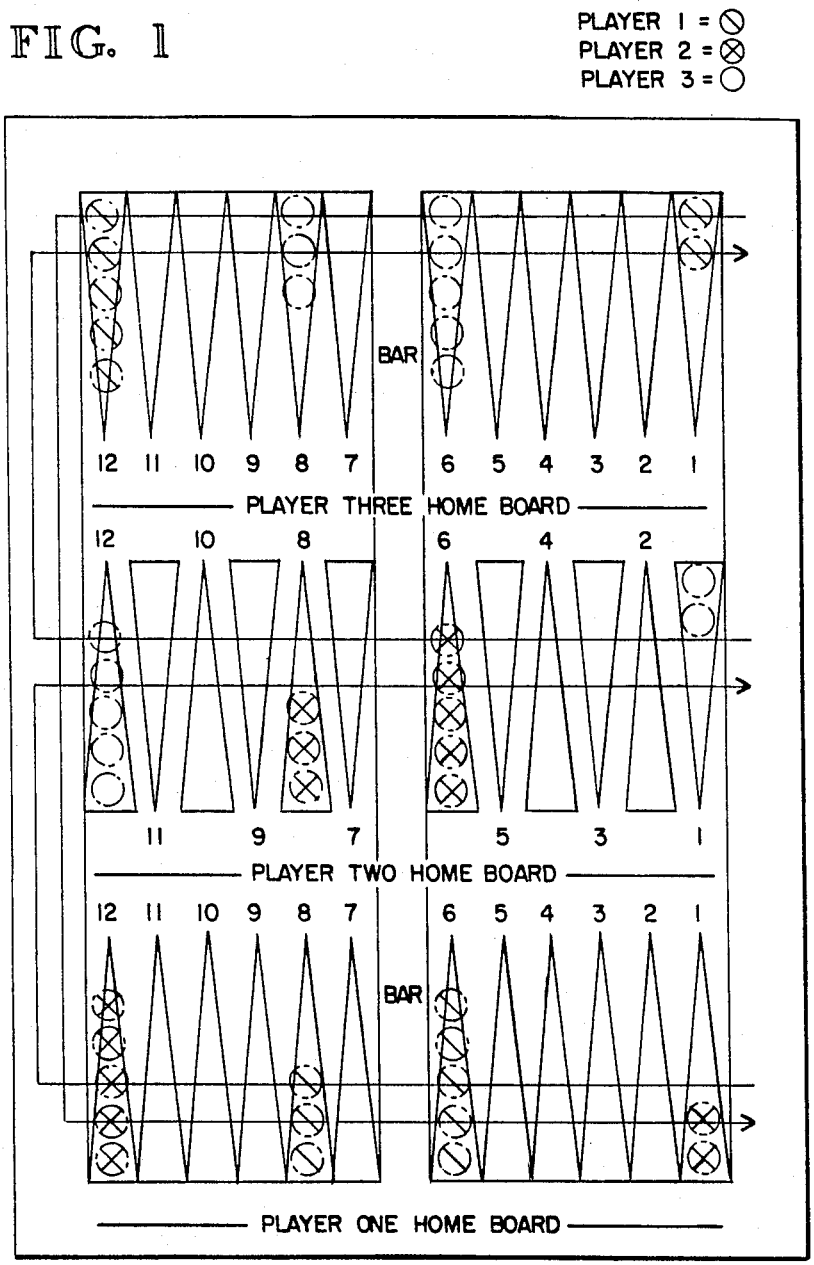
FIG. 1 shows a layout of a preferred board showing the starting position for playing backgammon with three players.

Referring now to FIG. 1, three substantially parallel rows of twelve points each comprise a preferred gameboard. To play three-person backgammon according to the method of this invention, each player sets his fifteen men as shown. The three rows conveniently allow a row to be designated as the home and outer boards for each player. On the six points of an inner table, the player for that home board may bear off his men as in backgammon. Each player begins with eight men on his home and outer boards; five are placed on the six-point, three on the eight-point. Each player also starts with seven men on the boards of an opponent. These seven men are positioned with five on the twelve-point and two on the one-point. Thus, but for color or shape difference between the three sets of points and men, each pair of rows will appear to be set for a traditional backgammon game. The twenty-four points on which a player initially positions his men restricts his course to those twenty-four points until his man is hit. A man will move to the next highest point on his opponent's boards, will cross from twelve-point to twelve-point, and will descend in order the points of his outer and home boards. All men must be within the lowest six points before a man may be borne off the board. If no men are hit, a player shall encounter each of his opponents only over twelve-points. Full overlap is possible, however, and the possibility allows added excitement and complexity for the game.

In Dutch backgammon, Acey-Deucey, European Acey-Deucey, and Tabard Backgammon, the possibility of full overlap which also exists.

Figure 4:
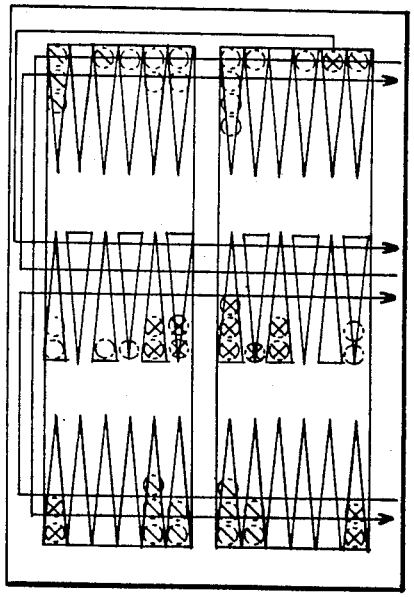
FIG. 4 shows a man entering on the two point of an opponent outside the standard path of twenty-four points which its other men will follow. Also shown is the path of twenty-four points which this newly entered man will follow.
Figure 5:
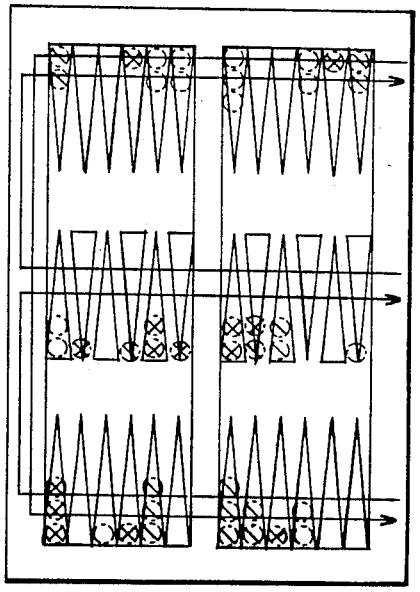
FIG. 5 shows the interaction of all three players which might develop in a particular game of backgammon.

When hit, a man may return to the board on either of the opponents' home boards. As shown in FIG. 4, a newly entering man may redefine its twenty-four point path. While men originally positioned to ascend one opponent's home and outer boards and to descend its own outer and home boards are confined to those boards, the reentering man may ascend through the home and outer board of the other opponent. This feature leads to fascinating turns in play. The intrigue is not over until all men are on their own outer and home boards. So long as two players overlap, there remains the possibility for overlap with all three. FIG. 5 shows a position which might develop in a typical game. Contact over all thirty-six points with both opponents is possible. The game ends when one player has completed bearing off all fifteen of his men.

A variation of the game with doubling as a factor results in a partnership against the initial wagerer. Any player may offer the first double, and thereafter the right to double the previous count alternates, being always with either of the two players not making the last double. Each player has the right to accept or to decline an offered double. Thereafter, players form temporary alliances in strategy of play so that the two players offered the double join in effort to defeat the player making the double. These temporary alliances are useful in avoiding or reducing payment of the stakes, for if one of the two players accepting the double wins, only the losing player who made the last accepted double is required to pay. If only one player declines a double, the game continues and he continues to play but cannot thereafter offer a double nor collect any stakes if he wins. The object of continued play for him is, then, to prevent the player offering the last double from winning and thus avoid having to pay the stakes for which he is responsible. Of course, alliances change at each accepted double, as the two players offered the double change, respectively.

In scoring, a gammon (double game) is won against an adversary if he has not borne off a single man. That player is, then, responsible to pay double the stakes. A backgammon (triple game) is won against an adversary if he has not borne off a single man and has a man, or men, in an opponent's home board or upon the bar. A backgammoned player is, then, responsible for triple the stakes. A trigammon is the term used to indicate a win in which both opponents lost a multiple stake game. For the player making the last double, rewards can be great if the win is achieved as both opponents must pay the appropriate stakes to him for his loss.

Dutch backgammon, Acey-Deucey, European Acey-Deucey, and Tabard backgammon are all played similarly to backgammon for three, but each with its characteristic starting setup and modified moving rules. Those familiar with these games will readily understand their adaptation to three-player games by studying the backgammon method just described.

Figure 2:
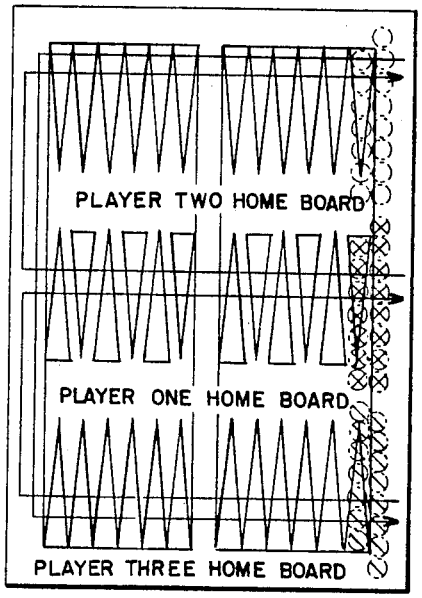
FIG. 2 shows a layout of a preferred board showing the starting position for either plakoto or gioul.
Figure 3:
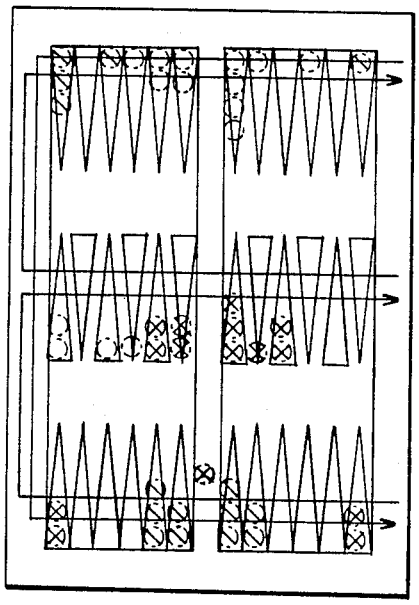
FIG. 3 shows a layout of a preferred board during the play of a backgammon game according to the method of this invention.

To play gioul or plakoto, each player begins with all of its men on the one-point of an opponent's home board. Of course, two sets of men may not occupy the same one-point. Thus the typical starting position will be that of FIG. 2. Playing on twenty-four points, each player ascends through the home board from whence it starts, through the outer board, crosses from twelve-point to twelve-point, and descends through his own outer and home boards. Thus each player will interact with each opponent so that on its first twelve points of travel, it encounters a first opponent, while on its second twelve points of travel, it encounters a second opponent. On this path, each player moves his men according to the rules common to plakoto or gioul. If doubles become unplayable in the three-person play of gioul, the next player in sequence has the opportunity to assume the remaining values. If this player becomes blocked, the third player may play the values. After finishing the play, play continues in the ordinary sequence, each player rolling two dice in turn and waiting the rolls of both opponents before rolling again.

For convenience, the sequence of points on the outer and home boards will ordinarily follow an ascending order from the one-point closest to the bearing off point to the twelve-point farthest away therefrom. FIG. 1 shows this sequencing. Also, a bar may intersect the gameboard. This bar customarily will disect the board to form six tables of six points each. A gameboard of this preferred construction will appear as a common backgammon board if any one row is covered. The gameboard may be easily used for traditional backgammon. Each gameboard ordinarily will come with three sets of fifteen men so that any of the methods of this invention may be played. The men may be color-coded to the points of the gameboards. Alternatively, each set of men may have a characteristic shape different from the others. Each man must be distinguishable from men of the other sets; otherwise they will be unrecognizably mixed during play of the games. At least one set of dice is included in a game set to allow play. Other chance means counting from one to six may be used.

While particular embodiments of this invention have been shown and described, this invention is not limited to them unless limitation is necessary due to the prior art or spirit of the appended claims. Modifications which fall within the true spirit of the principles disclosed in this description are meant to be included to the extent possible.

I claim:

1. A game board especially suited for three-person play comprising a field of play including a rectangular, planar area substantially free from holes including three substantially parallel rows of twelve points each, and a bar intersecting each of the three rows between its sixth and seventh point, the bar dividing the field into two smaller rectangles each rectangle including eighteen points having six points from each row.

2. The game board of claim 1 wherein the points are isoceles triangles having apexes and bases and wherein the central row of the three rows alternates the arrangement of the apexes and bases while the outer rows each have the bases in a predetermined orientation for each row.

3. The game of claim 1, further comprising forty-five men capable of being placed on the gameboard at one time during play.

4. The game of claim 3 wherein each man is a disc, the forty-five men are separable into three distinct groups of 15 men each, each group being identifiable visually by indicia on each man.

5. The game of claim 4 wherein each space is long enough to include a row of at least five men without overlap on another space.

* * * * *